United States Patent [19]

Jernigan et al.

[11] 4,355,808

[45] Oct. 26, 1982

[54] WEIGHTED, INLAID GOLF IRON AND METHOD OF MAKING SAME

[75] Inventors: Doyle D. Jernigan; Margaret Caskey, both of Temple, Tex.

[73] Assignee: Golf Division, Wood-Arts Company, Inc., Temple, Tex.

[21] Appl. No.: 248,423

[22] Filed: Mar. 27, 1981

[51] Int. Cl.[3] ..... A63B 53/04; B29D 3/00

[52] U.S. Cl. ..... 273/169; 273/173; 273/DIG. 3; 264/74; 264/129; 264/246; 264/255; 264/267; 264/271.1; 264/279

[58] Field of Search ..... 273/167 A, 167 R, 167 F, 273/167 H, 167 J, 169, 173, 171, DIG. 3; 264/275, 271.1, 277, 129, 279, 73, 74, 245, 246, 267, 269, 250, 255

[56] References Cited

U.S. PATENT DOCUMENTS

| | | | |
|---|---|---|---|
| 2,328,583 | 9/1943 | Reach | 273/171 |
| 2,846,228 | 8/1958 | Reach | 273/167 F |
| 3,140,094 | 7/1964 | Hings | 273/167 F |
| 3,230,284 | 1/1966 | Iverson et al. | 264/73 |
| 3,250,536 | 5/1966 | Moser | 273/167 F |
| 3,328,499 | 6/1967 | Barnette | 428/15 |
| 3,356,782 | 12/1967 | Whyte | 273/171 |
| 3,515,619 | 6/1970 | Barnette | 428/15 |
| 4,253,667 | 3/1981 | Clark et al. | 273/171 |

*Primary Examiner*—Willard E. Hoag

*Attorney, Agent, or Firm*—Reed, Smith, Shaw & McClay

[57] ABSTRACT

The present invention provides a method for preparing an inlay in golf irons which includes preparing an iron having a large cavity in its back and placing a preselected number of small weights in the bottom inner spline of the club and covering said weights with a first layer of epoxy. A second layer of epoxy having a decorative material included is placed over the first layer shortly after the first layer has set. During the setting of the second layer it is swirled a number of times. A protective coating is applied over the second layer after it has substantially cured.

6 Claims, 2 Drawing Figures

WEIGHTED, INLAID GOLF IRON AND METHOD OF MAKING SAME

FIELD OF THE INVENTION

The invention relates to a method for making a golf club, iron, having a decorative inlay in its back and in particular to a method for providing a decorative inlay and proper swing weight.

BACKGROUND OF THE INVENTION

Golf has become a well known sport over the last century. During that period of time various types of clubs have been used so that today the typical set of golf clubs consists of woods and irons each having a particularized slope to its face. The irons are normally made of a cast steel with or without additional weights being inlaid to provide a "sweet spot" which improves the performance of the club.

Golf irons have been manufactured by the assignee of this invention in which decorative wood inlays are placed within a cavity in the rear of the club. In such clubs, small weights are also added to the cavity and secured in place by a layer of adhesive to adjust the weight of the club head. In the manufacture of such clubs, the decorative wood inlay is inserted within the cavity after the weights have been permitted to settle to the bottom of the iron, but prior to the drying of the adhesive. A protective coating is then applied over the wood to protect the club head.

It is an object of the present invention to provide a decorative inlay which is long lasting and stable. It is a further object of the invention to provide an inlay where the weights are precisely positioned to provide an iron with good lift and carry and which club weight can be tailored to the individual golfer's swing.

SUMMARY OF THE INVENTION

Generally, the method of the present invention comprises casting an iron with a large cavity in the rear. Small weights, preferably of a size similar to B-B's, are then positioned along the bottom innermost edge of the cavity or spline of the club. Preferably, a standard #8 lead shot is used. The number of weights are selected on the basis of an indididual golfer's swing weight. In most cases this amounts to between 219.5 grams and 229 grams.

The weights are distributed along the innermost bottom edge of the cavity to maximize the lift and carry imparted to the ball by the club. The weights are fixed in position by applying a first layer of epoxy over them. An epoxy such as Polygem #139, made by Polygem Products of Addison, Illinois is preferred. This epoxy is poured to a depth of about one-eighth of an inch and is permitted to set.

A second decorative layer is prepared by mixing an epoxy, such as Polygem 139, with a decorative material such as pearl or metallic dust and color pigments. The decorative epoxy is poured into the cavity substantially filling the cavity. Perferably, the second layer is about one-half inch in thickness. During the period in which the second layer is curing, it is preferably swirled to impart a decorative swirl to the layer. Swirling is most desirably carried out every thirty minutes for the first two hours.

A protective coating is applied after the second layer has cured or approximately twenty-four hours after pouring. The final or protective coating is preferably a two-part clear epoxy resin, such as Star Sheen Supreme made by Hallmark, and is poured to cover the decorative coating. In the preferred embodiment, the protective coating is approximately one-eighth of an inch in thickness.

The inlay of the present invention is extremely stable and unique in appearance. Additionally, the weights are accurately positioned to afford the most desirable "lift" and "carry" characteristics for each individual golfer's swing. Other advantages of the invention will become apparent from a perusal of the following detailed description of a preferred embodiment of the invention taken in connection with the accompanying drawings.

PREFERRED EMBODIMENT

Figure 1:
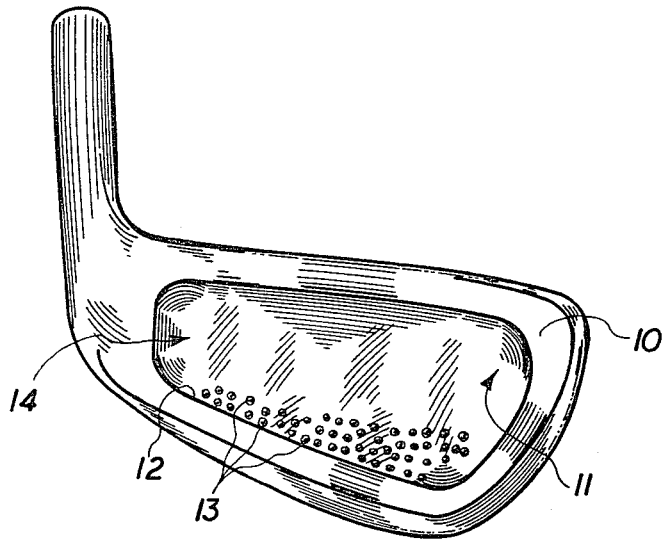
FIG. 1 is a rear elevation of a golf iron having a first epoxy layer provided in accordance with the invention and FIG. 2 is a rear elevation illustratively showing the inlay of the present invention.
Figure 2:
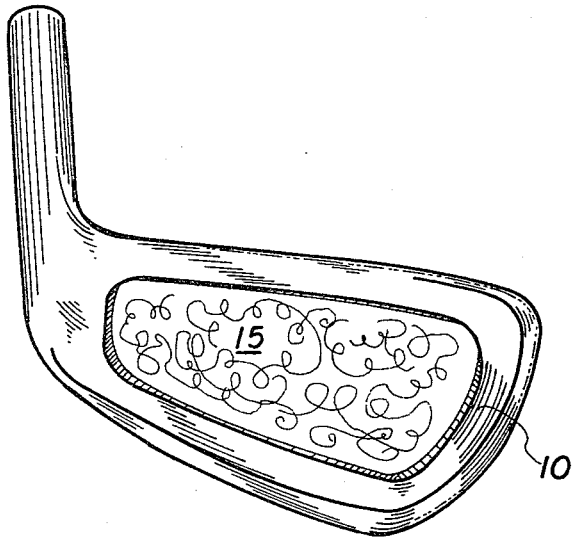

Referring to FIG. 1, club head 10 is shown having a large cavity 11 in the rear. Cavity 11 occupies a substantial portion of head 10. Small weights 13 are positioned along the inner most bottom edge 12 of cavity 11. The number of weights (total number of grams) is based upon the individual golfer's swing weight, but can be set at 222 grams for the statistically normal golfer.

The weights are positioned within cavity 11 by a first clear epoxy layer 14. Preferably, the epoxy is Polygem #139. First layer 14 is approximately $\frac{1}{8}''$ in thickness but depends in some part with the number of weights 13 used. A second layer 15 is provided which comprises a decorative layer made up of epoxy and decorative additives. The epoxy used in the second layer is preferably the same as in first layer 14. Various decorative additives such as pearl luster or metallic dust mixed with a colour agent are mixed with the epoxy to provide decorative layer 15. Examples of various combinations found useful include:

EXAMPLE 1

Brown Swirl 7 grams Pearl Opaque Luster
5 grams Transparent Orange
1.5 grams Bronze Powder

EXAMPLE 2

Bronze & Topaz 7 grams Pearl Opaque Luster
5 grams Yellow Food Coloring

EXAMPLE 3

Abalone & Pearl 7 grams Pearl Opaque Luster
1.5 grams White Opaque

EXAMPLE 4

Scarlet Swirl 7 grams Pearl Opaque Luster
5 grams Red Food Coloring

Preferably, decorative layer 15 is about one-half inch in thickness. During the setting of the epoxy, layer 15 is periodically swirled, for example, every thirty minutes during the first two hours of the cure.

After layer 15 has cured or within about 24 hours, a final or protective coating is applied. Preferably, the protective coating is a clear epoxy resin, which is applied to a thickness of about one-eighth of an inch.

While a presently preferred embodiment of the invention has been described and shown in particularity, it may be otherwise embodied within the scope of the appended claims.

What is claimed is:

1. A method for preparing a decorative inlay in a golf iron comprising the steps of:

a. preparing a cavity in the rear of said iron;

b. positioning a preselected number of small weights only along the inner most bottom edge of the cavity;

c. placing a first epoxy layer in said cavity to substantially cover and secure said weights;

d. adding a decorative epoxy layer to said cavity after said first epoxy layer has set, said decorative epoxy layer substantially filling said cavity and covering said first epoxy layer; and e. placing a protective coating over said decorative epoxy layer after said decorative layer has set.

2. A method as set forth in claim 1 including the step of swirling said decorative epoxy layer while it is setting.

3. A method as set forth in claims 1 or 2 wherein said decorative epoxy layer comprises a mixture of epoxy and coloring agent, said coloring agent comprising a transparent or opaque color pigment.

4. A golf iron having an inlay prepared in accordance with claims 1 or 2.

5. A golf iron having an inlay prepared in accordance with claim 1, wherein said inlay is of a swirl pattern.

6. A golf iron having an inlay in accordance with claims 1 or 2 wherein said first layer is about one-eighth inch in thickness and said decorative layer is about one-half in thickness.

* * * * *